US009169715B2

(12) United States Patent
Alhaug

(10) Patent No.: US 9,169,715 B2
(45) Date of Patent: Oct. 27, 2015

(54) DOWN HOLE WELL TOOL PROVIDED WITH A PISTON

(75) Inventor: Espen Alhaug, Stavanger (NO)

(73) Assignee: REELWELL AS (NO)

( * ) Notice: Subject to any disclaimer, the term of this patent is extended or adjusted under 35 U.S.C. 154(b) by 671 days.

(21) Appl. No.: 13/382,523

(22) PCT Filed: Jul. 2, 2010

(86) PCT No.: PCT/NO2010/000261
§ 371 (c)(1),
(2), (4) Date: Jan. 6, 2012

(87) PCT Pub. No.: WO2011/005107
PCT Pub. Date: Jan. 13, 2011

(65) Prior Publication Data

US 2012/0103592 A1 May 3, 2012

(30) Foreign Application Priority Data

Jul. 6, 2009 (NO) ..... 20092546

(51) Int. Cl.
*E21B 23/10* (2006.01)
*E21B 23/04* (2006.01)
*E21B 33/12* (2006.01)
(Continued)

(52) U.S. Cl.
CPC ..... *E21B 33/1277* (2013.01); *E21B 17/1078* (2013.01); *E21B 23/04* (2013.01); *E21B 23/10* (2013.01); *E21B 33/1208* (2013.01); *E21B 43/10* (2013.01)

(58) Field of Classification Search
CPC ..... E21B 17/1078; E21B 17/1014; E21B 17/1085; E21B 17/10; E21B 43/103; E21B 33/1208; E21B 33/10; E21B 33/12; E21B 43/105; E21B 23/00; E21B 23/10; E21B 33/1277; E21B 23/04; E21B 43/10
USPC ..... 166/153, 277, 384, 206, 212, 188, 101; 175/325.3, 325.1, 325.2, 325.5
See application file for complete search history.

(56) References Cited

U.S. PATENT DOCUMENTS 2,942,667 A 6/1960 Blood
3,151,690 A 10/1964 Grable
(Continued)

FOREIGN PATENT DOCUMENTS

WO 03/048508 A1 6/2003

OTHER PUBLICATIONS

International search report, international application No. PCT/NO2010/000261, Mar. 1, 2011.
(Continued)

*Primary Examiner* — Shane Bomar
*Assistant Examiner* — Wei Wang
(74) *Attorney, Agent, or Firm* — Adenike Adebiyi

(57) ABSTRACT

A down hole well tool (1) comprising a tool unit comprising at least one first fluid conduit (2) and a return fluid conduit (3) in use forming a well annulus between the tool unit and a well bore, and at least one piston (4) dividing the well annulus into well annulus spaces. The piston comprises at least two piston bodies wherein a first piston body (4*a*) is arranged to rotate with the tool unit and a second piston body (4*b*) is arranged in a position in between the first piston body and the well bore. The first piston body is arranged to rotate relative the second piston body and first sealing means are arranged in between the first piston body and the second piston body.

5 Claims, 3 Drawing Sheets

(51) Int. Cl.

| | |
|---|---|
| ***E21B 33/127*** | (2006.01) |
| ***E21B 17/10*** | (2006.01) |
| ***E21B 43/10*** | (2006.01) |

(56) References Cited

U.S. PATENT DOCUMENTS

| | | | | |
|---|---|---|---|---|
| 3,638,742 | A * | 2/1972 | Wallace | 175/325.3 |
| 4,057,118 | A | 11/1977 | Ford | |
| 4,534,426 | A | 8/1985 | Hooper | |
| 2004/0069504 | A1 | 4/2004 | Krueger | |
| 2007/0169943 | A1 | 7/2007 | Vestavik | |

OTHER PUBLICATIONS

International preliminary report on patentability, international application No. PCT/NO2010/000261, Aug. 2, 2011.

* cited by examiner

DOWN HOLE WELL TOOL PROVIDED WITH A PISTON

BACKGROUND

1. Field of the Invention

The invention relates to a down hole well tool having at least two fluid conduits.

2. Description of Related Art

U.S. Pat. No. 4,534,426 ("Hooper") discloses a packer and pressure differential drilling tool and method of controlled pressure balanced drilling in big hole well bores and shafts. The tool and method are characterized by a large diameter packer slidably engaged with the well bore over a drill bit and through which a dual drill pipe operates and isolates drilling fluid from a hydrostatic head of fluid standing in the well bore surrounding the dual drill pipe. The packer functions as a non-rotatable ram slidable down the well bore and supporting the hydrostatic head and applying weight to the drill bit

SUMMARY

The invention concerns a down hole well tool comprising a tool unit comprising at least one first fluid conduit and a return fluid conduit in use forming a well annulus between the tool unit and a well bore, and at least one piston dividing the well annulus into well annulus spaces.

The down hole well tool in accordance with the invention may be used for drilling, well cleaning, installation of casings, well completion, workovers and for other well operations.

The return fluid conduit may be arranged in the first fluid conduit, leaving an annular space in between the first fluid conduit for the flow of a first fluid, wherein the return fluid may be arranged to pass in the centrally arranged space of the return fluid conduit.

The tool unit in accordance with the invention is operated by the differential fluid pressure brought about over the piston(s) of the tool unit, due to the characteristics of the fluid provided at either side of the piston. In the case where the tool unit includes one piston, this piston isolates the well annulus into two separate well annulus spaces. In other cases two or more pistons are included in the tool unit, thereby dividing the well annulus into a correspondingly number of well annulus spaces. By the introduction of pressurized fluid into one of the well annulus spaces the following differential fluid pressure occurring over the piston may be used for displacing the whole tool unit in the well bore or for displacing the piston relative the tool unit. The piston may be provided with means for communication of fluid from one well annulus space at one side of the piston through the piston and to the other well annulus space at the other side of the piston. This may be useful in many ways, such as when setting and the retrieving the down hole well tool and also when using the tool for the expansion of a casing. The communication of fluid between the adjacent well annulus spaces may be controlled in various ways; by the differential fluid pressure over the piston, by electrical, mechanical or hydraulic signals, or by the relative movement between the first fluid conduit and a control element.

The piston may be provided solely as a sealing element or may be made up by different portions having sealing characteristics and ridgid characteristics for providing strength and conducting necessary operations such as expansion. Further the piston may be provided in one piece or made up by two or more elements. The piston may be operated inside a casing or it may be operated in a well bore hole which has not been cased. The piston may be provided to be moved relative the tool unit in an axial direction of the well bore or may be arranged to be moved with the tool unit in an axial direction relative to the well bore. The piston may also be used for operating other components related to down hole operations, and may for instance be used for carrying out casing expansion procedures when operating an expansion module to be set at a position in a casing.

It is desirable to be able to move the fluid conduit and the piston in an axial direction relative to well bore and possibly also to be able to move the piston and the fluid conduit relative each other in an axial direction of the well bore, to carry out the necessary drilling and well related operations. It may also be desirable to be able to rotate the fluid conduit and the piston relative the well bore and also to rotate the fluid conduit relative to the piston. To be able to keep the well annular spaces isolated from each other, it is essential to provide a sufficient sealing system between the parts to be axially displaced and rotated. The sealing needs to be provided in between the first fluid conduit (such as a drill string) and the piston, and the piston and the wall of the well bore/casing. Consequently the sealing arrangement needed for this application must be provided to allow for rotation and axial displacement to take place. When arranging a sealing system between the parts to be moved it is necessary that the wall of the well bore, the surfaces of the tool unit preferably the first fluid conduit and the piston provide adequate arrangement for holding the sealing arrangement in a correct position.

As it is complicated to obtain a sufficient holding for such a sealing arrangement against the wall of the well bore and at the first fluid conduit side of the sealing arrangement, a need has evoked to provide an alternative arrangement to avoid the mentioned problems with the fastening of the sealing arrangement. A basis for a solution to this problem is to arrange the down hole well tool with sealing surfaces which contribute to sufficient sealing effect in engagement with the sealing means.

The object of the invention is to provide an arrangement making the drawbacks of the solution described above redundant. This is achieved with the invention as defined in the independent claim wherein embodiments of the invention is presented in the following dependent claims.

In accordance with the invention the at least one piston comprises at least two piston bodies. A first piston body is arranged to rotate with the tool unit. A second piston body is arranged in a position in between the first piston body and the well bore. The two piston bodies may be placed in positions which are radially displaced relative each other. The positions of the two piston bodies are arranged in such a manner that the well annulus spaces provided by the piston dividing the well annulus, are kept well isolated from each other. The first piston body is arranged to rotate relative the second piston body. The second piston body may comprise an accommodation portion such as a hollow portion for the accommodation of the first piston body. Roller bearings may be provided between the first and second piston body to facilitate the rotation of the first piston body relative the second piston body. In one aspect the first piston body and second piston body may be arranged displaced relative each other in the axial direction of the tool unit.

First sealing means are arranged in between the first piston body and the second piston body. The first sealing means should be provided so that an effective sealing line is produced in between the piston bodies due to interaction between the first sealing means and the configuration of the surfaces of the first and second piston body facing the first sealing means. The first sealing means needs to be provided for allowing rotational movement between the first and second piston body, while still being able to provide a sufficient sealing preventing fluid leaking from one side of the piston to the other. The first sealing means may in one aspect be arranged so that a limited movement between the first and second piston body in the axial direction of the well bore is allowable. The first sealing means may of course also be capable of providing sufficient sealing line when no relative movement occurs between the first and second piston body.

Second sealing arrangement may be provided between the tool unit and the first piston body. The first piston body may comprise an accommodation portion such as for instance a hollow portion for the tool unit to run through. The first piston body is arranged to rotate with the tool unit and consequently a sealing arrangement allowing rotation between these two parts is not a principal feature of this sealing arrangement. However, in addition to providing a sealing effect when there is no movement between the parts, the second sealing arrangement should be arranged so that an effective sealing is provided during a relative movement between the first piston body (the piston) and the tool unit in the axial direction of the well bore.

The piston may be provided as an integrated part of the tool unit and may in that case be constituted as an enlarged portion of the first fluid conduit. In such cases the need for second sealing arrangement is made redundant.

Third sealing arrangement may be provided between the second piston body and the well bore or the casing. The second piston body may be arranged for axial displacement in the well bore, either relative to the tool unit or to be moved along with the tool unit. In either case the sealing arrangement in between the second piston body and the well bore/casing may be provided to produce an effective sealing preventing leakage of fluid in between the well annulus spaces when the piston/second piston body is moved in the axial direction of the well bore. The sealing arrangement needs to be effective when the second piston body moves relative to the wall of the well bore/casing as well as when no movement occurs in between the second piston body and the wall of the well bore/casing. In one aspect the second piston body is provided for some rotational movement. This rotational movement may be limited compared to the rotational movement of the first piston body. The second piston body, preferably the circumferential surface of the second piston body, may be provided with rolling means for this rotational movement to take place. In this aspect of the invention, the third sealing means needs to be prepared so that no leakage occurs in between the second piston body and the well bore/casing during the rotational movement of the second piston body.

In one aspect the piston may comprise further piston bodies arranged in between the first and second piston body.

The tool unit may be provided with means for centralizing the tool unit in the well bore. Further, sliding means such as slide bearing may be provided in between the second piston body and the well bore/casing to arrange for the axial movement of second piston body/piston to take place in the well bore/casing.

BRIEF DESCRIPTION OF THE DRAWINGS

An example of embodiments of the invention is illustrated in the attached figures and is to be described in following with reference to the attached drawings, where.

DETAILED DESCRIPTION

Figure 1:
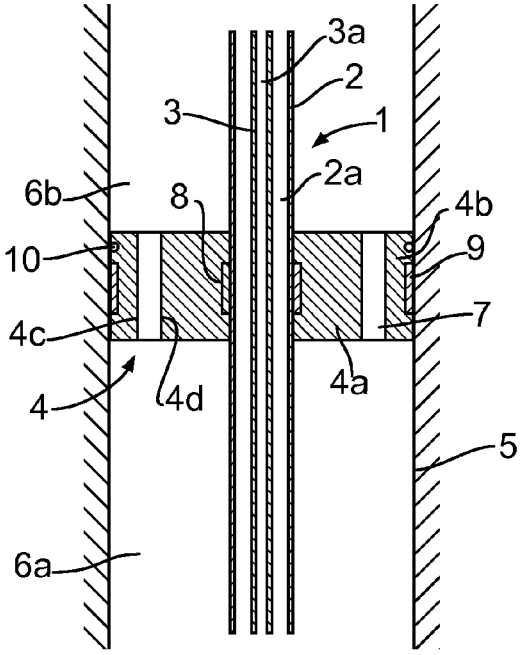
FIG. 1 shows a first embodiment of a piston of a down hole well tool.

FIG. 1 illustrates a first embodiment of down hole well tool showing a tool unit 1 arranged in the well bore 5. The tool unit 1 comprises a first fluid conduit 2 and return fluid conduit 3 positioned inside the first fluid conduit 2. Fluid such as a drilling fluid passes in the outer fluid path 2*a* and the return fluid flows in the inner fluid path 3*a*. The tool unit comprises a piston 4 positioned in the well bore 5 between the tool unit 1 and the wall of the well bore dividing the well annulus into well annulus spaces 6*a*, 6*b*. The tool unit 1 may also comprise more that one piston and in that case the well annulus will be divided into further annulus spaces. The tool unit 1 may also be used for the expansion of a casing and in that aspect the tool unit is prepared to run inside a casing.

The tool unit 1 runs through a hollow portion of a first piston body 4*a*, wherein the first piston body 4*a* is arranged to rotate with the tool unit 1 when the latter is rotating in the well bore 5. A second piston body 4*b* accommodates the first piston body 4*a* in a hollow portion of the second piston body 4*a* providing for the second piston body 4*a* to be arranged surrounding the first piston body 4*a* in a position radially displaced relative the second piston body 4*a*. The tool unit 1 and the first piston body 4*a* rotates together inside the second piston body 4*b*. There is no rotational movement or in some cases a restricted rotational movement of the second piston body 4*b*. The first and second piston body 4*a*, 4*b* is shown in line in a position wherein the first piston body 4*a* is accommodated inside the second piston body 4*b* and hence the two piston bodies are placed in corresponding axial positions relative to the tool unit. The two piston bodies 4*a*, 4*b* may also be arranged displaced relative to each other in positions wherein portions of the circumferential surfaces 4*c*, 4*d* still face each other and first sealing means is arranged between the two piston bodies. The circumferential surfaces 4*c*, 4*d* may also be provided with means for instance shapes fitting into each other to make sure that the first and second piston bodies 4*a*, 4*b* are not displaced relative each other in the axial direction of the well bore, but are being kept in essentially the same radial relationship as shown in the figs.

First sealing means 7 is arranged in between the first and second piston bodies 4*a*, 4*b* to prevent leakage from one of the well annulus spaces 6*a*, 6*b* to the other. First sealing means 7 has features making it capable of providing a sufficient sealing effect during the relative rotational movement between the two piston bodies, the first sealing means may be a dynamic seal.

Second sealing means 8 is arranged between the first piston body 4*a* and the tool unit 1 to ensure that there is no leakage in between the first piston body 4*a* and the tool unit 1. As there is no rotational movement between the tool unit 1 and the first piston body 4*a*, the second sealing means 8 need not be able to provide sealing effect during rotation, but it should be capable of providing sealing effect during a relative movement between the first piston body 4*a* and the tool unit 1 in the axial direction of the well bore 5. The piston 4 and thereby the first piston body is arranged to be moved axially in the well bore for instance when being used for the expansion of a casing or when conducting other down hole operations.

Third sealing means 9 is provided to prevent leakage between the second piston body 4*b* and the wall of the well bore or a casing. The third sealing means 9 should be able to provide a sealing effect when the relative movement in the axial direction occurs between the second piston body 4*b* and the well bore/casing, such as during expansion of a casing wherein the piston 4 and hence the second piston body 4*b* is moved relative to the well bore/casing. In one aspect the second piston body 4*b* is provided for some rotational movement, preferably that the rotational movement of the second piston body 4*b* is limited/restricted compared to the rotational movement of the first piston body 4*a*. To obtain the rotation of the second piston body 4*b*, rolling means 10 may arranged in the outer circumference of the second piston body 4*b*. The rolling means 10 may have an oblique orientation relative to the axial axis of the tool unit, thereby displaying a helical rotational movement of the second piston body 4*b*. When making the second piston body 4*b* capable of rotational movement, the third sealing means also needs to be provided to produce a sealing effect also during rotation of the second piston body 4*b* relative to the wall of the well bore or a casing.

Figure 2:
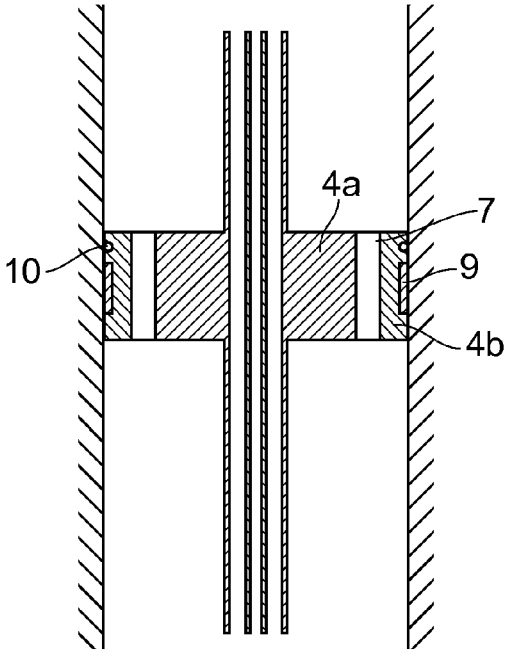
FIG. 2 shows a second embodiment of a piston of a down hole well tool.

FIG. 2 shows a second embodiment of the tool unit 1, wherein the first piston body 4*a* is made an integrated part of the tool unit 1. In accordance with an aspect of this embodiment the first piston body 4*a* may also be fixed by suitable means such as bolting means to the tool unit. There is no need for second sealing means when the first piston body 4*a* is made part of the tool unit 1, whereas the first and third sealing means as defined in the description of FIG. 1 are present. The description of the other parts of the invention as presented when explaining FIG. 1 also applies for this second embodiment of the invention.

Figure 3:
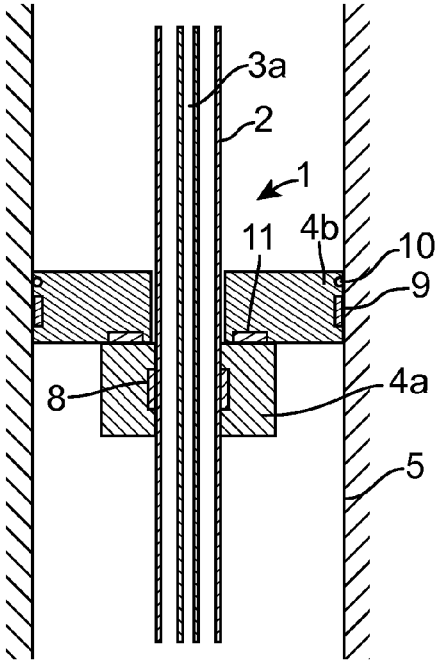
FIG. 3 shows a third embodiment of a piston of a down hole well tool.

In the third embodiment of the tool unit 1 as illustrated in FIG. 3 a different configuration of the first piston body 4*a* and the second piston body 4*b* is shown. The first piston body 4*a* is arranged to rotate with the tool unit and is provided with second sealing means 8 in an arrangement similar to the one described for FIG. 2. The second piston body 4*b* is positioned next to the first piston body 4*a* above, as shown in FIG. 3, or below the first piston body 4*a* displaced in the axial direction of the well bore 5. As in the embodiments shown in FIGS. 1 and 2, the second piston body 4*b* has a restricted rotational movement or none rotational movement. First sealing means 11 is present providing sealing effect between the two piston bodies during the rotation of at least the first piston body 4*a*, or in the case where a limited rotational movement of the second piston body 4*b* is allowed. The requirements for the first sealing means 11 as such is similar to those of the first sealing means 7 shown in FIGS. 1 and 2, although the first sealing means is arranged between the abutting end surfaces of the two piston bodies. The description of the other parts of the invention as presented when explaining FIG. 1 also applies for this embodiment of the invention.

Figure 4:
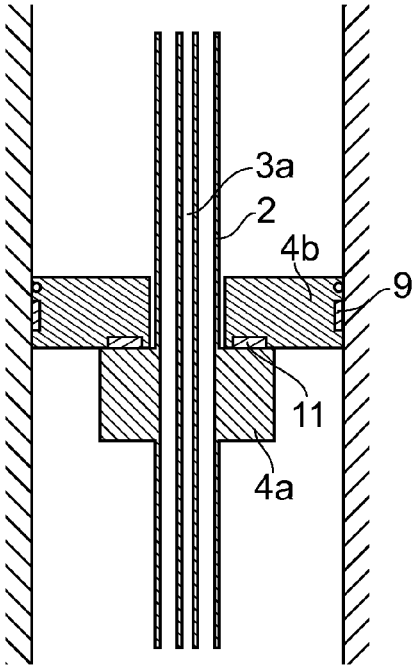
FIG. 4 shows a fourth embodiment of a piston of a down hole well tool.

FIG. 4 shows fourth embodiment of the tool unit 1 wherein the arrangement of the first piston body 4*a* is integrated or fixed to the tool unit, is similar to the arrangement in FIG. 2. The arrangement of the positions of the first and second piston 4*a*, 4*b* is similar to the configuration and provisions as described with reference to FIG. 3.

The description of the components of the invention as presented above in FIGS. 1 and 2 also applies to the embodiments of FIGS. 3 and 4, where the provision of components of FIGS. 3 and 4 are not defined otherwise.

Figure 5:
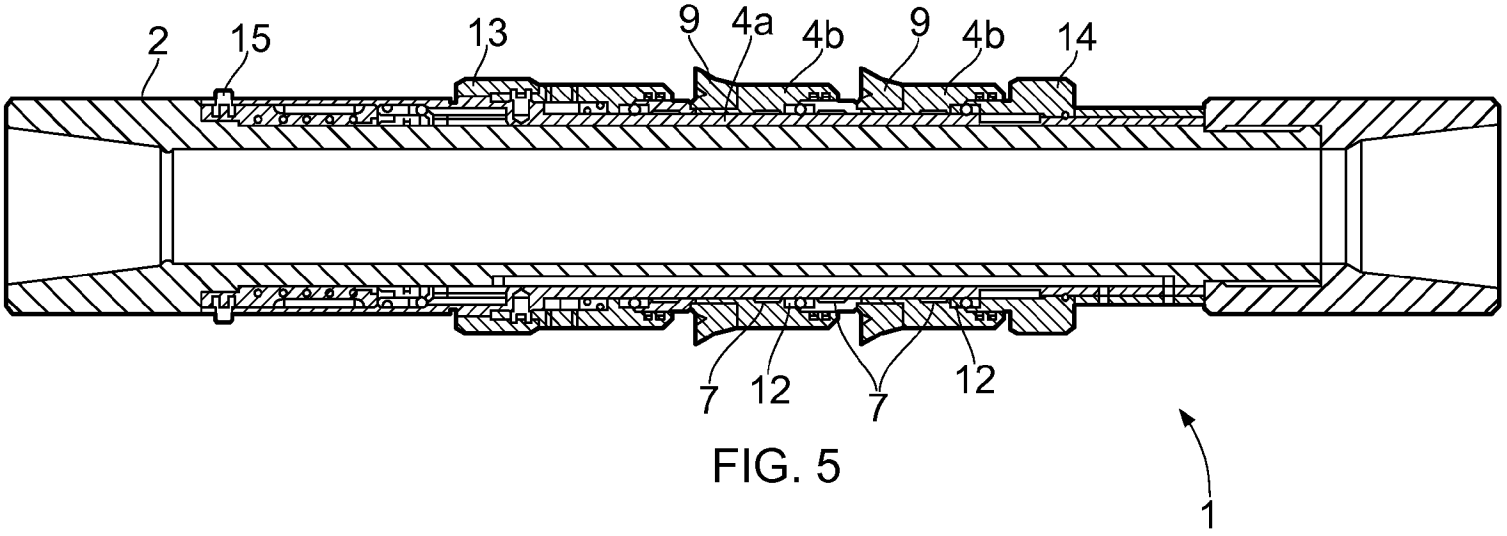
FIG. 5 shows a fifth embodiment of a piston of a down hole well tool.

FIG. 5 shows an embodiment of the invention wherein the inner first piston body 4*a* is fixed to the first fluid conduit 2 of the tool unit 1 by bolts 15. The tool unit 1 is provided with two second piston bodies 4*b*, each arranged with third sealing means 9. First sealing means 7 is provided in between the first piston body 4*a* and each of the two second piston bodies 4*b*. In addition to first sealing means 7, roller bearings 12 are provided between the first and second piston body 4*a*, 4*b* respectively to facilitate the rotational movement of the first piston body 4*a*. The tool unit 1 is further provided with upper and lower centralizers 13, 14 to make sure the first fluid conduit 2 is held in a centralized position in the well bore 5 wherein the second piston bodies 4*b* and the third sealing means 9 are centered in the well bore 5. The tool unit 1 in accordance with the embodiment shown in FIG. 5 and the other figures may in one aspect of the invention also be provided with slide bearings as a part of the centralizers 13, 14 or as separate components provided to facilitate the axial movement of the tool unit 1 in the well bore 5 or a casing.

The invention claimed is:

1. A down hole well tool comprising:

a tool unit comprising at least one first fluid conduit and a return fluid conduit, wherein in use a well annulus is formed between the tool unit and a well bore;

at least one piston for dividing the well annulus into well annulus spaces, the at least one piston comprising at least a first piston body and a second piston body, wherein the first piston body is arranged to rotate with the tool unit, wherein the second piston body is arranged in a position to be in between the first piston body and the well bore, and wherein the first piston body is arranged to rotate relative to the second piston body, and wherein the first piston body is disposable within an annulus of the second piston body such that the first and second piston bodies are placed in corresponding lateral positions relative to the tool unit;

a first sealing arrangement in between the first piston body and the second piston body; and a second sealing arrangement disposed on an outer circumference of the second piston body for sealing between the second piston body and the well bore, wherein the second sealing arrangement and the first and second piston bodies are place in corresponding lateral pistons relative to the tool unit.

2. A down hole well tool in accordance with claim 1, further comprising a third sealing arrangement between the tool unit and the first piston body.

3. A down hole well tool in accordance with claim 1, wherein an outer circumferential surface of the second piston body is provided with rolling means.

4. A down hole well in accordance with claim 1, wherein the tool unit is provided with means for centralizing the tool unit in the well bore.

5. A down hole well system comprising:

a tool unit disposed in a well bore such that a well annulus is formed between the tool unit and the well bore, the tool unit comprising at least one first fluid conduit and a return fluid conduit;

at least one piston dividing the well annulus into well annulus spaces, the at least one piston comprising at least a first piston body and a second piston body, the first piston body being arranged to rotate with the tool unit, the second piston body being arranged in a position between the first piston body and the well bore, the first piston body being arranged to rotate relative to the second piston body, the first piston body begin disposed within an annulus of the second piston body such that the first and second piston bodies are placed in corresponding lateral positions relative to the tool unit;

a first sealing arrangement disposed in the annulus between the first piston body and the second piston body; and a second sealing arrangement disposed on and outer circumference of the second piston body for sealing between the second piston body and the well bore, wherein the second sealing arrangement and the first and second piston bodies are placed in corresponding lateral positions relative to the tool unit.

* * * * *